United States Patent [19]

Moiroux et al.

[11] Patent Number: 4,461,613

[45] Date of Patent: Jul. 24, 1984

[54] HYDRAULIC PUMP WITH VARIABLE-STROKE PISTON AND GENERATOR USING SAID PUMP

[75] Inventors: August Moiroux, Ecully; Maurice Bouvier, Villeurbanne, both of France

[73] Assignees: Airmachines; Poclain Hydraulics, both of France

[21] Appl. No.: 359,995

[22] Filed: Mar. 19, 1982

[30] Foreign Application Priority Data

Mar. 23, 1981 [FR] France ..... 81 05770

[51] Int. Cl.[3] ..... F04B 49/00

[52] U.S. Cl. ..... 417/285; 417/299; 417/364

[58] Field of Search ..... 417/11, 299, 285, 340, 417/341, 342, 364

[56] References Cited

U.S. PATENT DOCUMENTS

| | | | |
|---|---|---|---|
| 689,272 | 12/1901 | Bailly | 417/285 |
| 1,001,295 | 8/1911 | Moorhead | 417/285 X |
| 2,387,603 | 10/1945 | Negebauer | 417/341 |
| 2,667,300 | 1/1954 | Huber | 417/364 X |
| 3,012,509 | 12/1961 | Mercier | 417/285 |
| 3,065,703 | 11/1962 | Harman | 417/364 |
| 3,606,591 | 9/1971 | Potma | 417/364 |
| 4,097,198 | 6/1978 | Herron | 417/245 |
| 4,307,999 | 12/1981 | Vanderlaan | 417/364 X |
| 4,382,748 | 5/1983 | Vanderlaan | 417/341 X |

FOREIGN PATENT DOCUMENTS

| | | |
|---|---|---|
| 420266 | 10/1925 | Fed. Rep. of Germany . |
| 2648958 | 5/1978 | Fed. Rep. of Germany . |
| 2758182 | 7/1978 | Fed. Rep. of Germany . |
| 2217529 | 9/1974 | France . |
| 1332799 | 10/1973 | United Kingdom . |

*Primary Examiner*—Leonard E. Smith
*Attorney, Agent, or Firm*—Lewis H. Eslinger

[57] ABSTRACT

The present invention relates to a double-acting hydraulic pump comprising a piston moving with a reciprocal rectilinear movement inside a cylinder of which each chamber is provided with a suction valve and a delivery valve, the rod of said piston being adapted to be driven by a variable-displacement driving member. The said piston rod extends beyond the piston and moves, outside the cylinder within a space of variable volume, provided in the body of the pump, which communicates, with a member controlling the by-pass device through which the two chambers of the cylinder communicate.

13 Claims, 11 Drawing Figures

1
2
3
4
5
6
7
8
9
10
11
12
13
14
14a
14b
14c
15
16
17
18
19
21
23
24
25
25a
26
27
28
29
30
31
32
33
34
34a
35
36
37
38
39
40
42
43
44
45
46
47
51
52
53
54
55
56
58
59
60
II
III
IV

IXa
IXb
IXa
IXb
1
2
4
5
6
8
14
14a
14b
14c
15
16
17
18
19
20
21
22
23
24
24a
24b
25
25a
26
27
28
29
30
31
32
33
34
34a
35
36
37
39
40
41
42-52
43
43a
44
45
46
47
48
50
51
55
59
60
101
114
114a
114b
115
115a
118
135
152

HYDRAULIC PUMP WITH VARIABLE-STROKE PISTON AND GENERATOR USING SAID PUMP

Many types of hydraulic pumps with double-acting piston are already known which comprise essentially, a cylinder inside which moves a plunger of which the rod is coupled to a driving member. The piston defines two chambers inside the cylinder each one being provided with a suction valve situated on a supply pipe connected to a hydraulic fluid tank and with a delivery valve opening into a delivery pipe connected to the apparatus using pressurized fluid.

Free piston internal combustion engines are also known, of which the serviceable power is regulated by the stroke of the piston. Such engines essentially comprise a combustion chamber into which are introduced a liquid or gaseous fuel and air for combustion, according to suitable cycles.

In some of these engines, an appropriate part of the piston moves inside a cylinder, defining two chambers therein. The first, called pumping chamber, is adapted to be placed in communication with the atmosphere with a view to being filled with air; that air is thereafter delivered into the combustion chamber to act as combustion air. The second chamber, called bounce-chamber, is also adapted to be supplied with air from the atmosphere, and constitutes an elastic element, pushing back the engine piston, and thereby ensuring the compression of the fuel-air mixture before its combustion. It is known that one of the main advantages of this type of engine is to avoid the necessity of having a mechanical connection between the piston and the fixed crankcase, whilst offering high security, compared with the risks presented by the free piston.

It was found advantageous to drive a hydraulic pump with an engine of the type briefly recalled hereinabove, to constitute a generator of pressurized hydraulic fluid, capable of supplying a flow of fluid automatically adapted to the requirements of the pressure-using apparatus. But beforehand the difficulties, presented by the use of a pump of which the working stroke, which varies with the power required, should be compatible with the stroke of the driving member, itself depending of the power supplied by the latter, have to be solved.

The present invention therefore relates first of all to a double-acting hydraulic pump whose piston is adapted to be driven by a variable-displacement driving member. In a pump of this type, the flow supplied is of course dependent on the power and return strokes of the piston, at least in the region of the maximum load of the pump and more precisely up to 60% of this maximum load. Below this load, it is noted that it becomes generally impossible to adjust the stroke of the driving member. It has already been proposed to this effect to limit the delivery flow by temporarily introducing losses of load (rolling) but such a solution has the serious disadvantage of causing a loss of energy which, in practice, results in an important reduction of the delivery pressure. It was therefore important to try and find a pump permitting, without any loss of energy, an automatic control of the delivered flow from the nil load to the maximum load of the pump.

According to the invention, the piston rod of the pump extends beyond the piston and moves, outside the cylinder, within a space of variable volume, provided in the body of the pump, which communicates with a member controlling the by-pass device of the two chambers of the pump cylinder.

This by-pass device can take various forms but, according to an advantageous characteristic of the invention, it is constituted by a piston valve moving in front of two orifices or ports communicating respectively with each one of the cylinder chambers, said piston valve being subjected, against the action of an adjustable spring (depending on the flow required from the pump), to the action of the pressure prevailing in said space of variable volume.

Another difficulty encountered with this type of pump results from the pulsatory working of the pressure due to the reciprocal movement of the piston. In general, a pulsatory pressure is not conducive to a good operation of the pressure-user apparatus and the pulses therefore had to be dampened as much as possible. To this effect, the pump according to the invention is provided on the delivery pipe with a fluid accumulator situated downstream of the delivery valves of each chamber.

The consequence of the aforesaid difficulty is that the flow sucked in by the pump is also pulsatory. Therefore, according to the invention, a fluid accumulator is placed upstream of the suction valves of each chamber, which fluid accumulator is fed by a booster pump driven by an auxiliary motor. The delivery pipe of which pump will be advantageously connected to the space of variable volume mentioned hereinabove so as to compensate for any leaks occurring during the operation of the by-pass device controlled by said space.

One of the main applications of the hydraulic pump, briefly described hereinabove is, as already indicated, its use with a free piston engine in order to constitute an autonomous generator of hydraulic power.

The invention also extends to this special application and relates in particular to a generator of pressurized hydraulic fluid which comprises a free piston engine, known per se, whereas the piston of the hydraulic pump, of the previously described type, is coupled to the piston of the engine and placed co-axially thereto, in order to constitute with said piston a monobloc movable assembly with no mechanical link with the outside. In this way, the advantages of the free piston engine mentioned hereinabove are preserved.

The invention however proposes, in the case of such a generator, to produce advantageously the auxiliary engine of the booster pump of the hydraulic pump. Such an auxiliary engine is driven by the pressurized air which exists in the bounce-chamber of the free piston engine. Preferably, the auxiliary motor will be a single-acting piston engine of which the piston is subjected, against the action of a return spring, to the action of the pressure prevailing in the bounce-chamber.

The invention will be more readily understood on reading the following description with reference to the accompanying drawings in which:

FIG. 1 is a longitudinal cross-section of a generator of pressurized hydraulic fluid according to the invention;

FIG. 1*a* is a view similar to FIG. 1, of a variant embodiment, limited to the area of the piston of the internal combustion engine;

Figure 1:
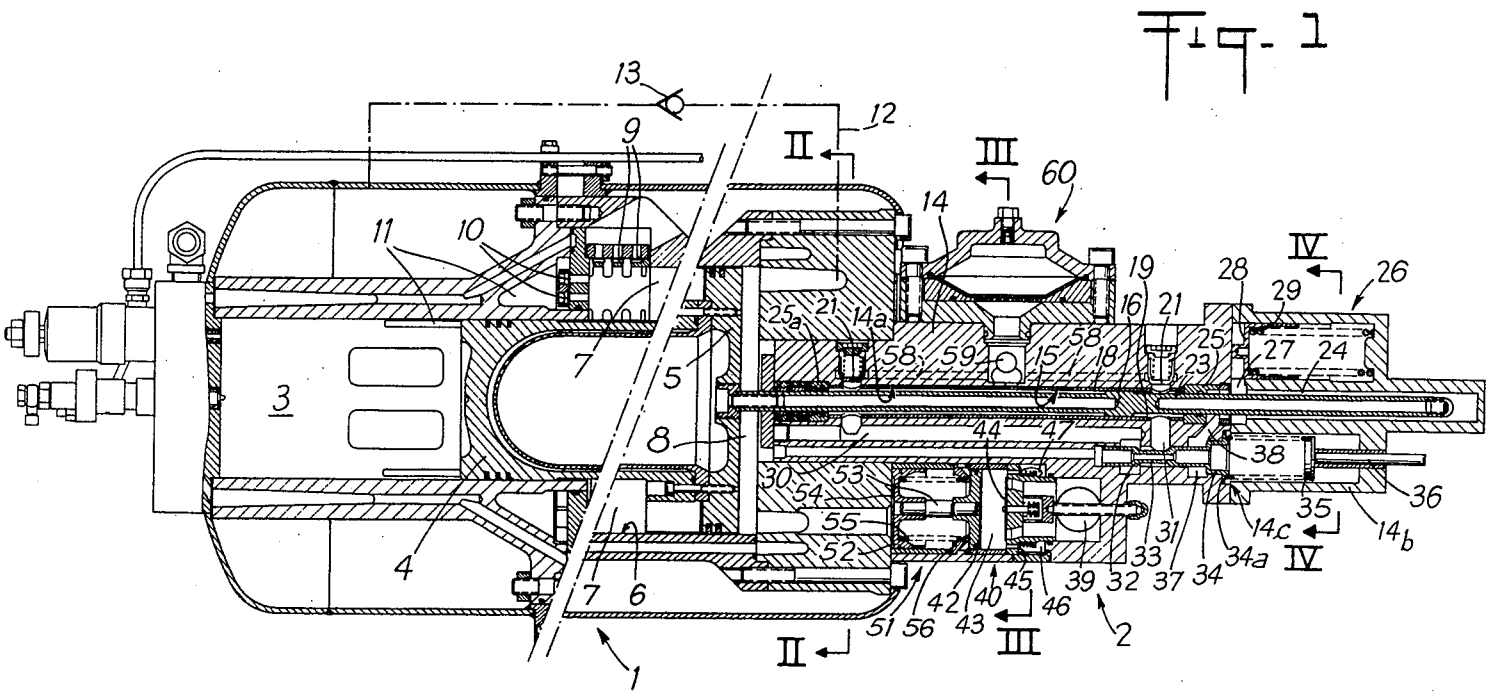

Referring now to FIG. 1, said Figure shows that a generator according to the invention essentially comprises a free piston engine designated by the general reference 1 and a hydraulic pump designated by the general reference 2.

The engine 1 is constituted, as we know, by a combustion chamber 3 in which moves a piston 4. In the illustrated example, the engine is a two-stroke Diesel engine. The piston 4 is provided at its end opposite the combustion chamber with an annular portion 5 which moves inside a cylinder 6 and defines, on the one hand, a chamber 7, called pumping chamber, and on the other hand, a chamber 8, called bounce-chamber. Valves 9 enable the chamber 7 to communicate with the atmosphere, whereas valves 10 open into conduits 11 which communicate with the combustion chamber, when the piston 4 uncovers the corresponding ports. A conduit 12, represented diagrammatically, and provided with a valve 13 enables to fill the bounce-chamber 8 with the air contained inside the pumping chamber 7, in particular to compensate for the air leaks which have occurred in said bounce-chamber during operation.

Without going into details on how such an engine works, it will be simply recalled that after the combustion of the air-fuel mixture in the combustion chamber 3, the piston 4 is moved back to uncover the scavenging ports of the conduits 11. At the same time, its annular portion 5 compresses the air contained inside the cushion chamber 8. The elastic power which is thus stored will be used to return the piston 4 inside the combustion chamber to compress the mixture previously introduced therein, for the next combustion.

The hydraulic pump 2, which is driven by the engine 1 is constituted by a body 14, secured to the body of the engine, in which is provided a cylinder 15, which is preferably co-axial to the cylinder 6 of the engine and to its combustion chamber 3. Preferably also, the cylinder 15 is constituted by a built-in lining, mounted inside the bore 14*a* of the body 14.

The piston 16 of the pump is coupled to the piston 4 of the engine by way of a piston rod 17, co-axial to the latter and constituting therewith a monobloc assembly. Said piston 16 thus defines inside the cylinder 15 two chambers 18 and 19, each one being provided with at least a suction valve 20 and a delivery valve 21.

Two sealing rings 25 and 25*a* seal the chambers 18 and 19 and further ensure the locking in position of the cylinder 15 in the axial direction, whilst allowing the passage of the piston rod 17 in conditions which will be specified hereinafter.

Figure 2:
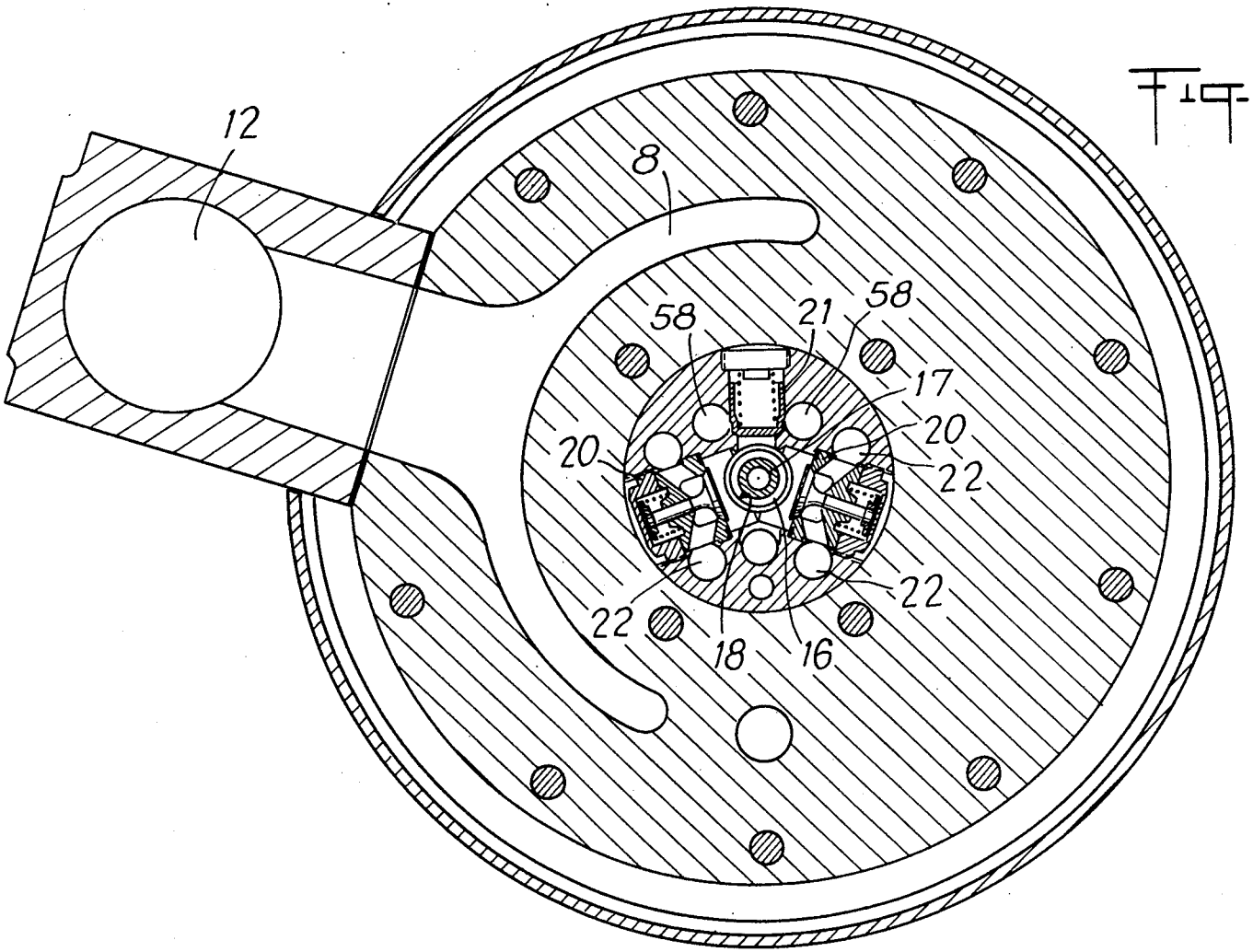
FIG. 2 is a cross-section along II—II of FIG. 1.

FIG. 2 shows suction valves 20 issuing into the chamber 18 and supplied by the conduits 22. The suction valves corresponding to the chamber 19 are placed likewise around the delivery valve 21 corresponding to said chamber.

Figure 1A:
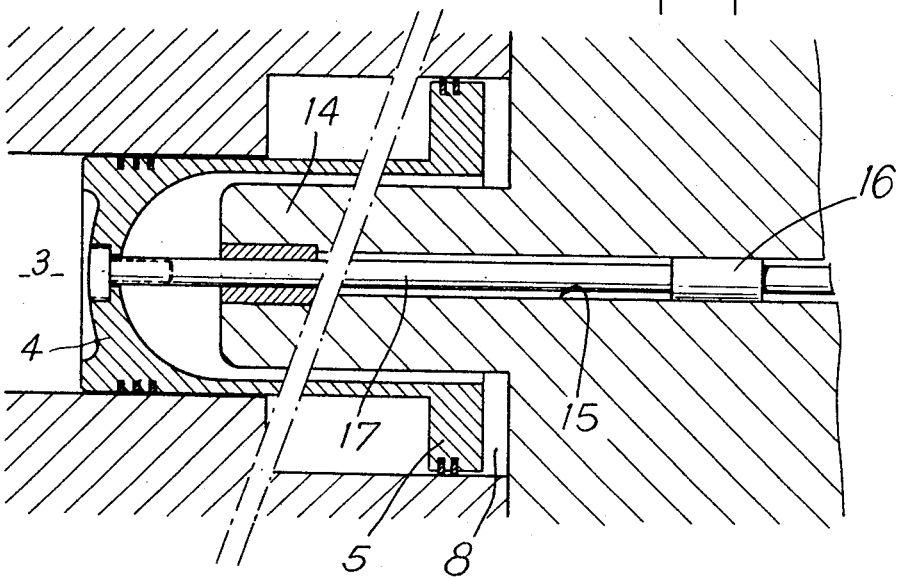

Although FIG. 1 shows an engine 1 of which the piston 4 receives the rod 17 of the piston 16 of the pump on its face opposite the combustion chamber, FIG. 1*a* shows a variant embodiment permitting to reduce the longitudinal volume of the generator.

To this effect, the face of the piston 4 opposite the combustion chamber is open and allows the latter to cover at least part of the body 14 of the pump when the movable set is in the position shown in FIG. 1. The bounce-chamber 8 extends then partly inside the piston 4, whereas the rod 17 of the piston 16 of the hydraulic pump is coupled to the piston 4 on its face limiting the combustion chamber.

On the side opposite said piston 16, the piston rod 17 is extended by a co-axial rod 23 which moves outside the chamber 19 inside a space 24 provided in a part 14*b* secured to the body 14 of the pump. The sealing ring 25 traversed by the rod 23 prevents the chamber 19 from communicating with the space 24. For reasons which will become apparent hereinafter, the volume of the space 24 should be variable. To this effect, an accumulator 26 communicates, via a conduit 27, with the space 24. It is constituted by a piston 28 which moves inside a cylinder chamber and is subjected to the action of a spring 29.

The two chambers 18 and 19 of the pump can communicate via a by-pass device which will now be described. The conduits 30 and 31 communicating respectively with the chambers 18 and 19 issue into a piston valve 32. In its rest position, shown in FIG. 1, the groove 33 of the piston valve 32 creates a communication between conduits 30 and 31. Said piston valve 32 is however coupled to a piston 34 subjected to the action of a spring 35 and, when in rest position, resting against the body 14 of the pump via its shoulder 34*a*. A control rod 36, adapted to be coupled to a pressure-using member, is mounted for sliding in the part 14*b* of the pump body and enables to adjust the calibrating force of the spring 35. Finally, a chamber 37, provided in the body of the pump and of which one wall is constituted by the piston 34 communicates with the space 24 via a conduit 38.

Reverting now to the device provided both for feeding hydraulic fluid to the pump 2 and for delivering said fluid, with a view to eliminating the drawbacks indicated hereinabove, which can be due to pulsatory feeding and delivery.

Figure 5:
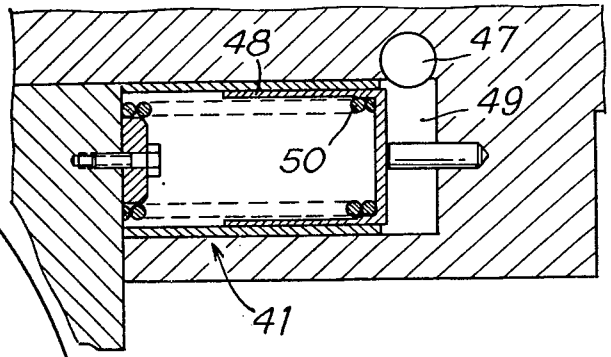
FIG. 5 is a cross-section along V—V of FIG. 3.
Figure 4:
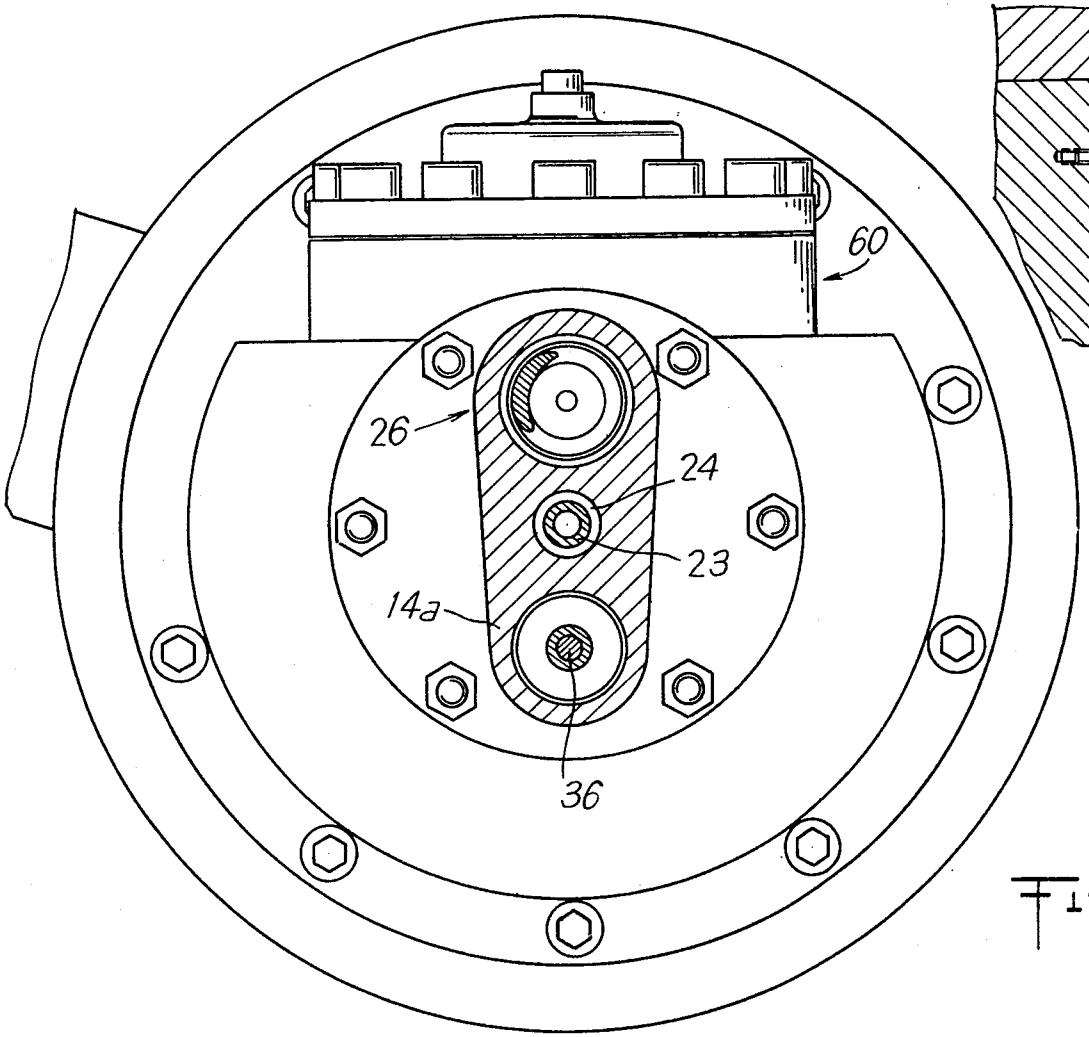
FIG. 4 is a cross-section along IV—IV of FIG. 1.

To this effect, a pump called booster pump, designated by the general reference 40 is provided from the supply orifice 39 which is connected to a fluid reservoir, as well as at least one accumulator 41 (FIGS. 3 and 5) to regulate the delivery pressure of said booster pump.

Figure 3:
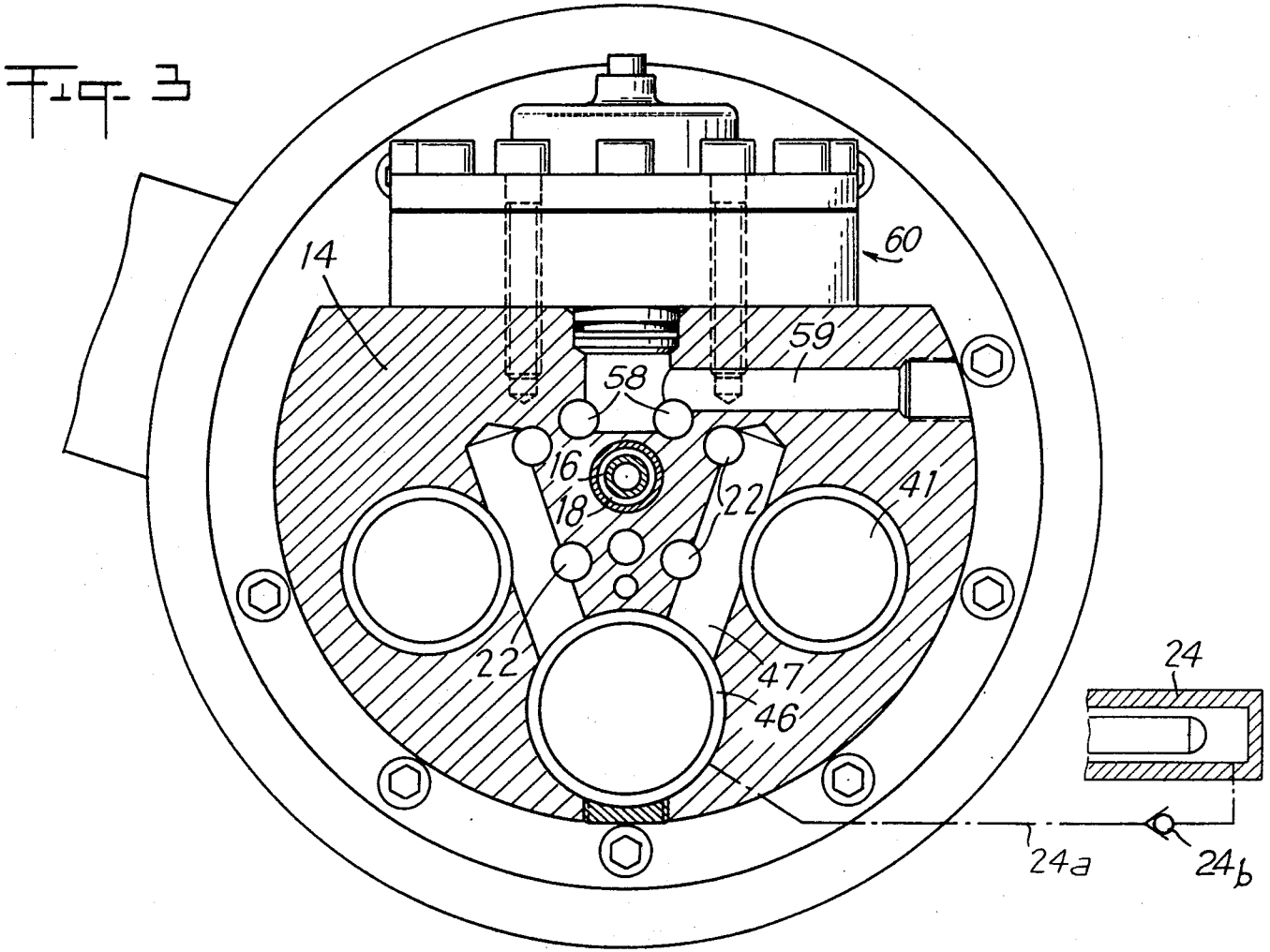
FIG. 3 is a cross-secton along III—III of FIG. 1.

Said booster pump is constituted by a piston 42 which moves inside a cylindrical chamber 43 of which one of the walls, constituted essentially by a plate 43*a*, comprises a suction valve 44 connected to the supply orifice 39. Moreover, delivery valves 45 enable the chamber 43 to communicate with a chamber 46, which is itself connected to the supply conduits 22 via a conduit 47 (FIG. 3). The accumulator 41 which comprises a piston 48 moving inside a chamber 39 and subjected to the action of a spring 50, by-passes the conduit 47.

The booster pump 40 or more precisely its delivery chamber 46, is also connected via conduit 24*a* equipped with a non-return valve 24*b* (diagrammatically represented by a broken line in FIG. 3) to the variable-volume space 24, so as to compensate for any leaks therefrom.

The piston 42 of the booster pump is driven by an auxiliary engine designated by the general reference 51. In the example illustrated in FIG. 1, said engine comprises a piston 52 coupled to the piston 42 by means of a rod 53 and moving inside a chamber 54 against the action of a spring 55 which rests against a ring 56 secured to the pump body. In its rest position, shown in FIG. 1, the piston 52 also rests against the engine body 1. The chamber 54, of which one of the wall is constituted by the piston 52 is in communication with the bounce-chamber 8 of the engine 1 via a conduit 57.

As regards the delivery of the hydraulic pump 2, conduits 58 collect the fluid which has flowed through the valves 21 and are connected to a main delivery pipe 59 designed to be in communication with the pressure-user apparatus. An accumulator 60 which in the illustrated example is of the type with diaphragm, by-passes the conduit 59.

Figure 7:
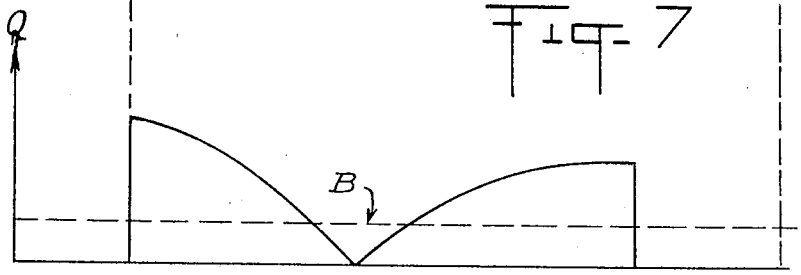
FIG. 7 is a diagram similar to that of FIG. 6, in the case of a partial average flow B.
Figure 8:
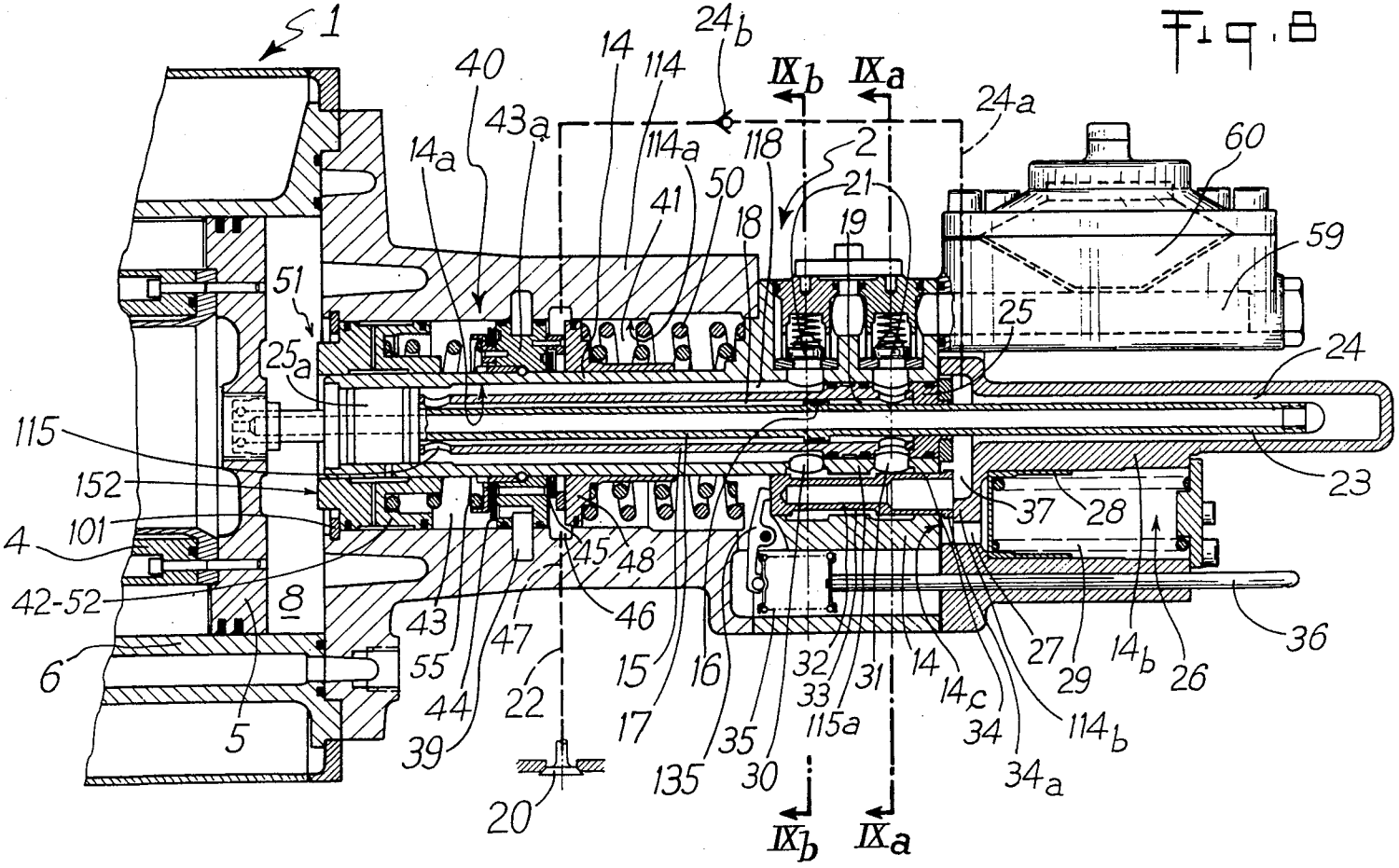
FIG. 8 is a view similar to FIG. 1 of an advantageous embodiment, with a number of parts removed for clarity in the region of the internal combustion engine.
Figure 9A:
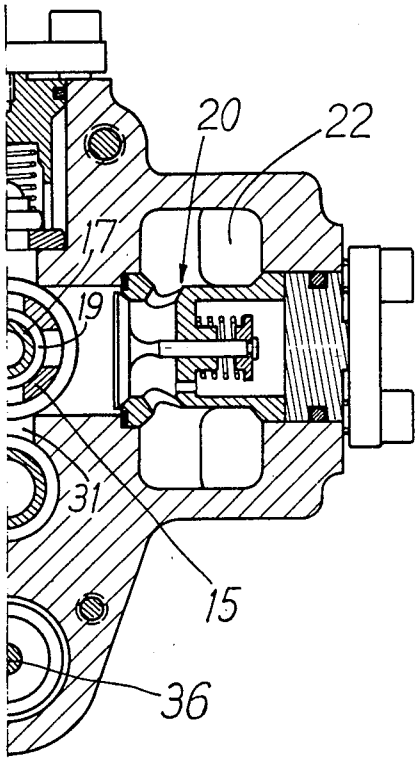
FIGS. 9*a* and 9*b* are half-cross-sections along IXa—IXa and IXb—IXb of FIG. 8.
Figure 9B:
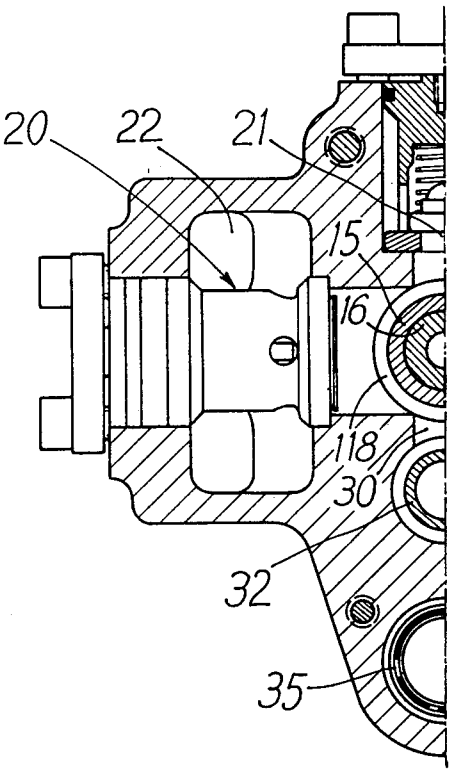

Before explaining how the pump described in reference to FIGS. 1 to 5 works, certain features of the advantageous embodiment shown in FIGS. 8 and 9 should be explicated. In these figures, the same reference numbers are used as in FIGS. 1 to 7 to designate the same members. A few additional reference numbers will be used however, starting with number 100.

The characteristics of the embodiment shown in FIGS. 8 and 9 essentially concern the structure of the body of the hydraulic pump 2, as well as the constitution of the booster pump 40 and of its one accumulator 41, these last two members being situated co-axially to the rod 17. This disposition permitting indeed to reduce the overall size of the generator.

Over most of its length, the cylinder 15 of the pump has an external diameter which is less than that of the bore 14*a* of the body 14 of the pump. It is provided at its left end (engine side) with orifices 115, so that the chamber 18 issues into the annular space 118 situated between the bore 14*a* and the cylinder 15. But, at its end opposite the orifices 115, the cylinder 15 comprises a portion 115*a* of which the external diameter is identical to the internal diameter of the bore 14*a*: the annular space 118 can thus be tightly sealed from the chamber 19. Owing to this disposition, the suction and delivery valves 20 and 21 respectively, which correspond to chamber 18 can be regrouped near those which correspond to chamber 19.

This disposition leaves clear the left part (engine side) of the pump 2, wherein a booster pump 40 and accumulator 41 are placed in conditions to be specified hereinafter.

It should however be noted that in the present variant, the action of the spring 35 on the piston valve 32 is exerted towards the right of FIG. 8 due to the lever 135. Thus, in its rest position, shown in FIG. 8, the piston valve 32 ensures, via its groove 33, a communication between the conduits 30 and 31, whereas the piston 34 placed at its end opposite the lever 135, rests directly by its shoulder 34*a* on the shoulder 114*b* of the part 14*b* secured to the body 14 of the pump. Like in the preceding embodiment, the fluid contained in the space 24 and in the accumulator 26 can act on the piston 34 in the direction opposite to the action of the spring 35.

The constitution of the booster pump 40 which is shown in FIG. 8 is substantially different from that previously described, although with the same main members.

A housing 114 secured to the engine 1, is provided around the pump body 14, said housing presenting a central bore 114*a* co-axial to the rod 17. An annular plate 43*a* is secured in the space situated between the body 14 and the housing 114. On the engine side, the plate 43*a* defines an annular chamber 43 in which moves the piston 42 of the booster pump. The face 152 of the piston 42, situated on the engine side, closes the bounce-chamber 8 and will thus constitute the piston 52 of the engine 51 of the booster pump. It can also be said that the piston 42 of the booster pump and the piston 52 of the engine 1 constitute a monobloc assembly. A snap ring 101 limits the axial displacement of the piston 42-52 under the action of the spring 55 resting against the plate 43*a*.

On the side of chamber 43, the plate 43*a* is provided with an annular suction valve 44 connected to the supply orifice 39. On the other side, the plate 43*a* is provided with an annular delivery valve 45 permitting a communication between the chamber 43 and a chamber 46, which latter is in turn connected to the suction pipe 20 of the pump 2 via the conduits 47 (provided in the housing 114) and 22, diagrammatically represented in FIG. 8.

The chamber 46 is sealed by the annular piston 48 of the damping member 41, said piston 48 being subjected to the action of the spring 50 resting against the body 14 of the pump 2.

A fact already realized by anyone skilled in the art is that the annular disposition of the booster pump 40 and of its accumulator 41 enables to do away with numerous clearances such as the conduit 57 and the chamber 54 of the engine 51, as well as the chamber 49 of the damping member 41 which, here, coincides with chamber 46. Moreover, the conduits 47 and 22 can be shorter and less in number than in the embodiment shown in FIGS. 1 to 5.

Finally, it is obvious that the conduits 24*a* and its valve 24*b*, the roles of which have been explained hereinabove, will be provided in the casing 114 and in the body 14 of the pump, although they are shown in broken lines in FIG. 8.

The pump 2 works then as follows, regardless of the embodiment.

The "power stroke" of the movable assembly consisting of piston 4-rod 17-piston 16-rod 23 designates its displacement under the effect of combustion in the combustion chamber 3. In FIGS. 1 and 8, this displacement is from left to right. The "return stroke" will designate the displacement in the reverse direction of said movable assembly.

It will first of all be assumed that the pump 2 supplies its maximum flow rate, i.e. that the control rod 36 is in the position shown in the drawings and corresponding to the minimum force of calibration of the spring 35. In these conditions, the minimum pressure inside the space 24 is sufficient to push back the piston 34 completely against the action of the spring 35, the shoulder 34*a* coming then in resting contact on the abutment 14*c*. The piston valve 32 is thus held in its position where it closes the communication between the conduits 30 and 31.

During the "power stroke" of the movable assembly, the volume of the chamber 18 increases and is filled with fluid coming for example from the accumulator or accumulators 41 through the suction valve or valves 20. The volume of the chamber 19 on the contrary reduces and the fluid contained therein is delivered through the corresponding valve 21, towards the accumulator 60 and from there towards the discharge conduit 59.

Similar operations occur during the "return stroke" of the movable assembly, the roles played respectively by the chamber 18 and 19 being reversed.

Figure 6:
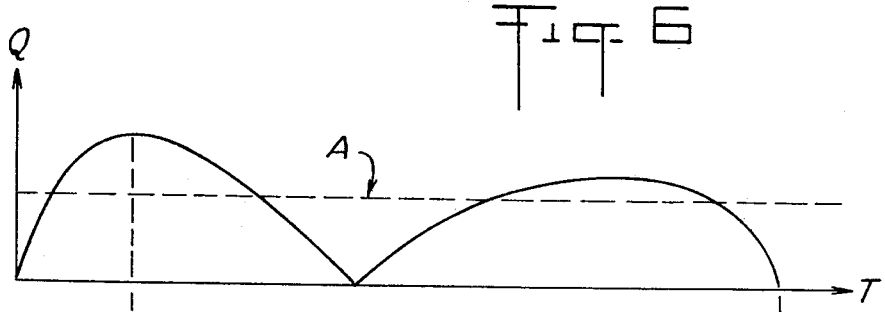
FIG. 6 is a diagram showing the instant flow Q of the hydraulic pump, as a function of time T, in the case of an average flow A approaching the maximum flow.

FIG. 6 gives a graphical representation of the instant flow of the pump 2 (i.e. the quantity of liquid delivered per unit of time) as a function of time. Due to the presence of the accumulator 60, the average flow represented by the broken line A is substantially constant despite important variations in the instant flow, on the one hand during a displacement of the movable assembly, and on the other hand, between the "power stroke" and the "return stroke".

It is indeed known that, in an engine of the type described hereinabove, the speed of the "power stroke" is higher than that of the "return stroke".

Assuming now that the pressure-using apparatus only requires a flow which is less than the maximum flow, the delivery pressure will increase, thereby causing a reduction in the length of the "power and return strokes" of the movable assembly, the power of engine 1 being kept virtually constant by its own control. However, as indicated hereinabove, the automatic adjustment of the flow of the pump in relation to the requirements is only possible over a certain load range which can vary between the maximum load and about 60% thereof.

If the flow required by the pressure-using apparatus continues to reduce, an appropriate control acts on the rod 36 to compress the spring 35. The minimum pressure of the space 24 is then no longer sufficient to hold the piston 34 permanently against the abutment 14c.

At the beginning of the "power stroke" the pressure inside the space 24 is close to the minimum pressure. The spring 35 therefore holds the piston 34 and the piston valve 32 in the position shown in FIG. 1 or FIG. 8, thereby allowing the chamber 18 to communicate with the chamber 19. The fluid delivered from the chamber 19 goes directly into the chamber 18 via the conduits 31 and 30. The instant flow delivered by the pump is then nil as can be seen in FIG. 7.

This situation will continue until the pressure increases inside the space 24, due to the rod 23 being driven in by a value sufficient to push the piston 34 against the spring 35. The piston valve 32 closes then the communication between the chambers 18 and 19 so that the pump is once more working normally. The instant flow returns to the value that it had when the pump was working at a maximum flow (FIG. 6) and decreases right until the end of the "power stroke".

At the beginning of the "return stroke" the pressure inside the space 24 is still high enough, due to the accumulator 26, to keep the piston valve 32 in its position sealing off the conduits 30 and 31. The fluid contained inside the chamber 18 is delivered towards the accumulator 60 and the general pipe 59. When the pressure inside the space 24 has sufficiently reduced, following the withdrawal of the rod 23, the spring 35 will return the piston valve 32 in the position shown in FIG. 1 or FIG. 8. The fluid delivered from the chamber 18 will pass directly into the chamber 19 and the instant flow of the pump will once again be nil. This situation will continue until the end of the "return stroke" and a new cycle will start again.

It is understandable that the average partial flow B (FIG. 7) can be adjusted to any desired value, by adjusting the compression of the spring 35 with the control rod 36. If the force of the spring 35 is sufficient to permanently hold the piston valve 32 in the position shown in FIG. 1, whatever the pressure inside the space 24, the average flow of the pump will be nil. The regulation proper of the engine 1 then acts on the latter in order to hold its power to a minimum value, no loss of energy being then recorded.

It should further be noted that the accumulator 60 is so dimensioned that its capacity enables to absorb and to restitute the fluid delivered from the chambers 18 and 19, whatever the variations in the instant flow due to the operation at maximum average flow as well as at partial average flow.

There now follows an indication of the conditions in which the booster pump 40, and the different members associated thereto, work to ensure a suitable supply of hydraulic fluid to the pump.

At each "power stroke" of the movable assembly, the air pressure inside the bounce-chamber 8 increases and acts on the piston 52 which it pushes back against the action of the spring 55.

The fluid contained inside the chamber 43 is then delivered through the valves 45 towards the chamber 46 and from there, towards the accumulator or accumulators 41 and the supply valves 20 via the conduits 47 and 22. The valves 20 only open if the chambers 18 and 19 need to be filled, this not being the case during the phases when said two chambers are communicating through the action of the piston valve 32.

If the accumulator or accumulators 41 are filled with fluid, the piston 42 cannot deliver the fluid from chamber 43 towards them and the piston 52 remains stationary. This situation however involves no risk since the piston 52 is elastically controlled by the air pressure inside the bounce-chamber 8.

The chamber 43 is filled through the valve 44 following the reduction of pressure caused by the return of the piston 42 to the position shown in FIG. 1 or FIG. 8, under the action of the spring 55.

What is claimed is:

1. A double-acting hydraulic pump capable of varying the amount of fluid supplied thereby through a continuum between a maximum and minimum flow, the pump comprising:

a piston moving with a reciprocal rectilinear movement inside a cylinder each chamber of which is provided with a suction valve and a delivery valve, a piston rod adapted to be driven by a variable-displacement driving member, a rod extension reciprocally movable with said piston for varying the pressure within a space of variable volume, a by-pass device for providing fluid communication between said chambers of said cylinder, wherein said by-pass device is operable in response to the pressure in said space for establishing communication between said chambers during a predetermined portion of said reciprocal movement of said piston, and control means cooperating with said by-pass device for selectively varying the length of said predetermined portion to any value between a maximum and a minimum length.

2. A hydraulic pump as claimed in claim 1, wherein said by-pass device establishes said communication when the pressure in said space is below a given value for a predetermined length at one end of said reciprocal movement of said rod extension and said space of variable volume communicates with a fluid accumulator for maintaining the pressure in said space above said given value during the remainder said cycle to maintain said by-pass device in a closed position.

3. A hydraulic pump as claimed in claim 1, wherein said by-pass device includes a piston valve movable in front of two orifices or ports communicating respectively with each one of the cylinder chambers, said piston valve being subjected, against the action of an adjustable spring (depending on the flow required from the pump), to the action of the pressure prevailing in said space of variable volume.

4. A hydraulic pump as claimed in claim 3, wherein said control means includes a member provided to adjust the force said spring and increasing the force of said spring reduces the flow of the pump.

5. A hydraulic pump as claimed in claim 1, wherein an accumulator of the fluid delivered by the pump is placed on a delivery conduit downstream of the delivery valve of each of the chambers of the piston cylinder.

6. A hydraulic pump as claimed in claim 1, wherein at least one accumulator of fluid is placed on the supply conduits of each chamber upstream of suction valves corresponding to said chambers.

7. A hydraulic pump as claimed in any one of the preceding claims, wherein a booster pump driven by an auxiliary engine provides fluid from a fluid reservoir, and is connected, via a delivery chamber thereof, with the supply pipe of each said chamber upstream of its suction valve and of the corresponding accumulator, and with said space of variable volume.

8. A hydraulic pump as claimed in claim 7, wherein the said booster pump comprises a piston moving inside a cylindrical chamber the face of which opposite that of the piston is equipped with a suction valve communicating with the fluid reservoir and with a delivery valve communicating with its delivery pipe.

9. A hydraulic pump as claimed in claim 8 wherein the piston and chamber of the booster pump include annular members placed inside a housing around a cylindrical portion of the pump body co-axially to said pump body.

10. A generator of pressurized hydraulic fluid, using the hydraulic pump claimed in any one of claims 1 to 6, and comprising an internal combustion engine the piston of which is coupled to the piston of the hydraulic pump, wherein said engine is a free piston type engine, and wherein said piston of the hydraulic pump is coupled to the piston of the engine and placed co-axially thereto, in order to constitute with said piston a monobloc movable assembly with no mechanical link with the outside.

11. A generator as claimed in claim 10, wherein said cylinder of the hydraulic pump extends at least partly inside the hollow piston of the engine, and wherein said piston rod of the hydraulic pump is coupled to the engine piston on the wall thereof which defines the combustion chamber.

12. A generator as claimed in claim 10, further comprising a booster pump for providing fluid from a fluid reservoir and supplying it to the supply pipe of each said chamber of said hydraulic pump and to said space of variable volume, said booster pump being coupled to an auxiliary engine with a single-acting piston, said piston being subjected to the action of the compressed air of the bounce-chamber of the internal combustion engine.

13. A generator as claimed in claim 12, wherein said piston of the auxiliary engine is subjected to the action of a spring which tends to return it to a rest position.

* * * * *